US011439560B2

(12) United States Patent
Chan

(10) Patent No.: US 11,439,560 B2
(45) Date of Patent: Sep. 13, 2022

(54) CASKET AND METHOD OF CONSTRUCTION

(71) Applicant: Sich Casket Company Limited, Hong Kong (CN)

(72) Inventor: Hung Sirius Chan, Hong Kong (CN)

(73) Assignee: Sich Casket Company Limited, Hong Kong (CN)

( * ) Notice: Subject to any disclaimer, the term of this patent is extended or adjusted under 35 U.S.C. 154(b) by 0 days.

(21) Appl. No.: 16/656,175

(22) Filed: Oct. 17, 2019

(65) Prior Publication Data

US 2020/0237598 A1 Jul. 30, 2020

Related U.S. Application Data

(60) Provisional application No. 62/745,332, filed on Oct. 13, 2018.

(51) Int. Cl.

| | |
|---|---|
| ***A61G 17/007*** | (2006.01) |
| ***A61G 17/00*** | (2006.01) |
| ***B27N 3/08*** | (2006.01) |
| ***B27N 3/20*** | (2006.01) |

(52) U.S. Cl.

CPC ..... *A61G 17/0073* (2013.01); *A61G 17/004* (2016.11); *B27N 3/08* (2013.01); *B27N 3/20* (2013.01)

(58) Field of Classification Search

CPC ..... A61G 17/0073; A61G 17/004; A61G 17/042; B27N 3/08; B27N 3/18; B27N 3/20; B27N 1/00; B27N 5/00; B27N 7/005

USPC ..... 27/4, 19; 264/320

See application file for complete search history.

(56) References Cited

U.S. PATENT DOCUMENTS

| | | | | |
|---|---|---|---|---|
| D203,539 | S | 1/1966 | Billman | |
| 3,367,004 | A * | 2/1968 | Schneider | A61G 17/042 27/3 |
| D223,903 | S | 6/1972 | Herricht | |
| 4,007,076 | A | 2/1977 | Clarke et al. | |
| 4,236,365 | A | 12/1980 | Wheeler | |
| 4,730,370 | A * | 3/1988 | Elder | A61G 17/00 27/4 |
| 4,967,455 | A * | 11/1990 | Elder | A61G 17/0073 27/4 |
| D346,264 | S | 4/1994 | Etzel et al. | |
| 5,454,141 | A * | 10/1995 | Ozbun | A61G 17/0073 27/4 |
| 5,709,016 | A * | 1/1998 | Gulick | A61G 17/00 27/2 |
| 5,862,847 | A * | 1/1999 | Jenkins | A61G 17/007 144/346 |
| 6,079,183 | A | 6/2000 | Moyes | |

(Continued)

FOREIGN PATENT DOCUMENTS

WO WO-9409741 A1 * 5/1994 ..... A61G 17/04

*Primary Examiner* — William L Miller

(74) *Attorney, Agent, or Firm* — Erickson Law Group, PC

(57) ABSTRACT

A casket and method for manufacture of a casket is described, and more particularly, for a casket having walls constructed of fiberboard such as medium density fiberboard (MDF). The walls have outside cladding of MDF that is molded or extruded to provide surface contours such as raised and/or recessed features without having to attach such features as separate trim pieces to the walls. The resulting casket provides aesthetic characteristics and strength for use in funeral ceremonies.

13 Claims, 3 Drawing Sheets

(56) References Cited

U.S. PATENT DOCUMENTS

| | | | | |
|---|---|---|---|---|
| 6,312,540 | B1 | 11/2001 | Moyes | |
| 6,571,440 | B1 * | 6/2003 | Faulkner | A61G 17/00 27/4 |
| 6,588,162 | B2 | 7/2003 | Lynch et al. | |
| 6,868,644 | B2 | 2/2005 | Frankefort et al. | |
| 7,426,806 | B2 | 9/2008 | Lynch et al. | |
| 7,730,686 | B2 | 6/2010 | Lynch et al. | |
| D622,474 | S | 8/2010 | Pulver et al. | |
| 7,820,268 | B2 | 10/2010 | Luetgert et al. | |
| 7,837,922 | B2 | 11/2010 | Lynch et al. | |
| 8,468,763 | B2 | 6/2013 | Lynch et al. | |
| 8,545,968 | B2 | 10/2013 | Lynch et al. | |
| 8,820,017 | B2 | 9/2014 | Lynch et al. | |
| 9,284,772 | B2 | 3/2016 | Lynch et al. | |
| 9,833,372 | B2 | 12/2017 | Denk et al. | |
| 2002/0053120 | A1 * | 5/2002 | Cox | A61G 17/00 27/4 |
| 2003/0122280 | A1 * | 7/2003 | Buehler | A61G 17/00 264/319 |
| 2005/0125974 | A1 * | 6/2005 | Ozbun | A61G 17/007 27/19 |

* cited by examiner

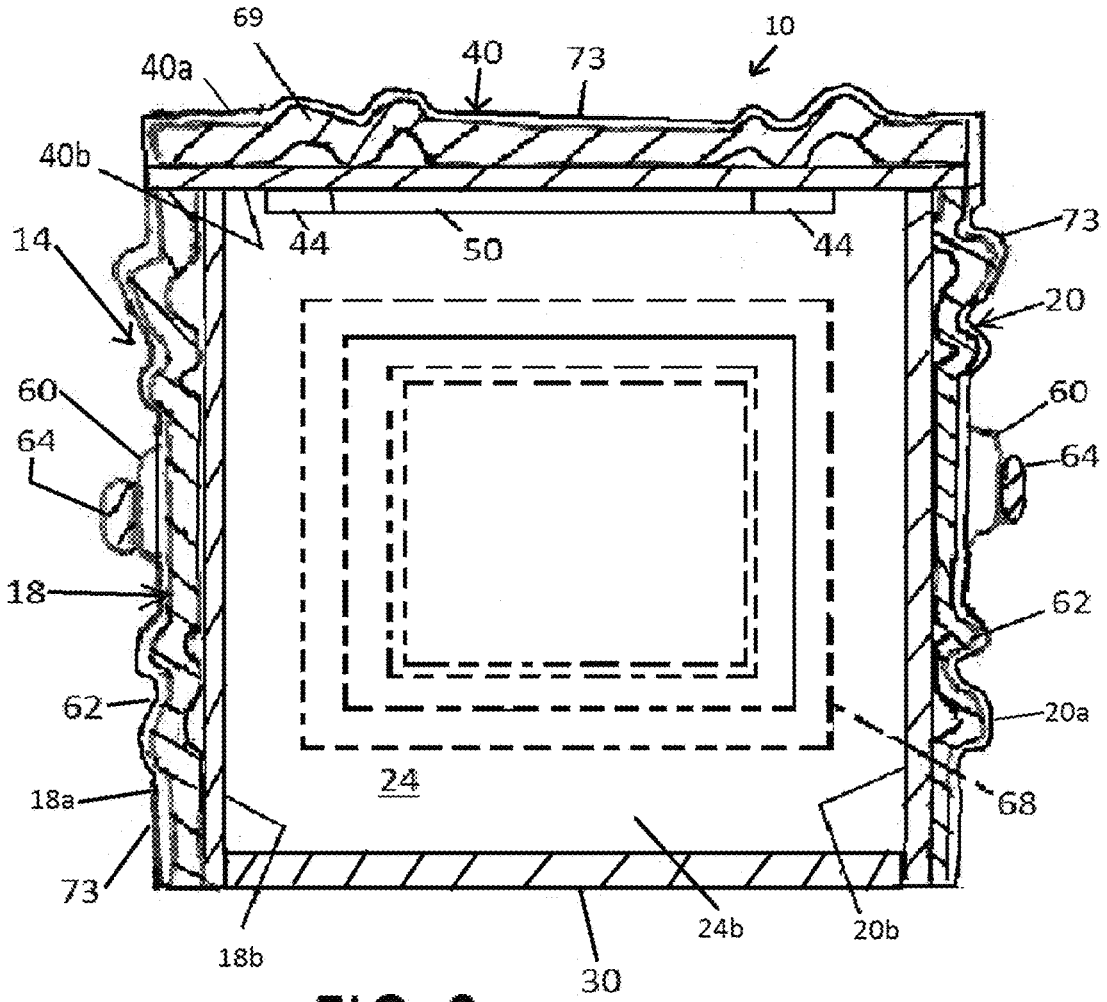
FIG. 2
FIG. 2A
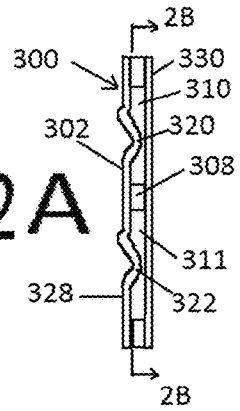
FIG. 2B
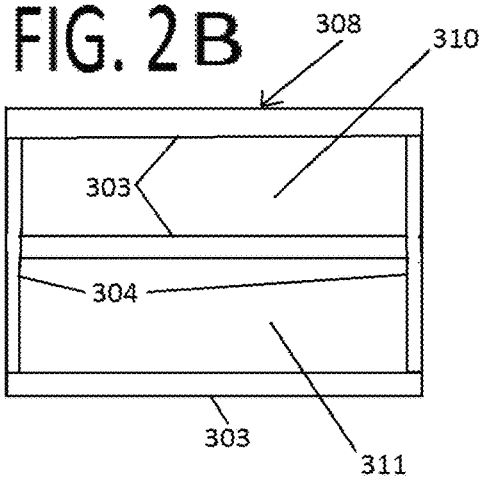

CASKET AND METHOD OF CONSTRUCTION

This application claims the benefit of U.S. Provisional Application Ser. No. 62/745,332, filed Oct. 13, 2018.

BACKGROUND

Caskets provide an aesthetically pleasing receptacle for the purpose of transporting the deceased and displaying the deceased during funeral ceremonies. Additionally, caskets are used for burial or for cremation processes.

Caskets are available in luxury and economy models. Economy models are particularly desirable when cremation is selected. Even for economy models, especially when cremation is desired, the casket should not be prohibitively expensive but at the same time, the casket should be strong and substantial in construction.

One example of a purported economical casket construction is disclosed in U.S. Pat. No. 5,862,847. This construction requires multi-ply walls and a corrugated fiberboard overlay to provide an aesthetically pleasing configuration.

Adding moldings and trim pieces to the walls and lids is not very common on wood caskets due to the extra cost of parts and labor. In addition, having moldings and trim pieces on flat walls increases the difficulty in sanding and painting the walls. It is difficult to justify the cost of these features on economy models.

The present inventor has recognized that it would be desirable to provide a casket and a method of manufacturing the casket that provides a cost effective construction that still provides a sturdy casket that is aesthetically pleasing. The present inventor has recognized that it would be desirable to provide a casket that reduces parts and assembly time.

SUMMARY

The exemplary embodiments of the present invention generally relates to a casket and method for manufacture, and more particularly, to a casket having wall cladding constructed of fiberboard such as medium density fiberboard (MDF) that are molded or extruded to provide surface contours such as raised and/or recessed features without having to attach such features separately to casket walls. The resulting casket provides aesthetic characteristics and strength for use in funeral ceremonies. The casket is economical to manufacture and of such a construction as to facilitate cremation.

By molding or pressing the raised and/or recessed features on a wood fiberboard wall cladding, manufacturing cost is significantly reduced and manufacturing time is significantly reduced. Additionally, the same press that forms the raised and/or recessed features can be used to apply paper veneer/laminate, wood veneer, or other laminate to a top of the fiberboard wall cladding. Alternately the fiberboard wall can be pressed or extruded to form the raised and/or recessed features without a laminate.

The exemplary embodiments of the present invention also relate to a casket and method of manufacturing a casket, using wood fiber board for wall claddings, and in particular but not exclusively using Medium Density Fiberboard (MDF) wherein raised and/or recessed formations, with considerable differences in height, are formed into the wall claddings, showing on the outside surfaces of the wall claddings. The deformation of wood fiberboard is known as "extrusion", whereby considerable plastic deformation, accompanied by flow and stretch of the material takes place.

An exemplary method of manufacturing caskets of the invention, comprises the steps of: providing a casket shell including opposite side walls and opposite end walls, a bottom wall and a lid; forming at least one of the side walls and end walls with a contoured outside surface by molding a flat fiberboard cladding, such as an MDF board between co-acting mold walls; and assembling the side walls, the end walls, the bottom wall and the lid with cladding into an openable box. The side walls, end walls and/or the lids can have contoured outside surfaces. The raised surfaces can provide raises and/or recessed rectangular trim portions or other decorative shapes.

Detailed methods of molding or extruding of medium density fiberboard into contoured surface shapes is disclosed for example in U.S. Pat. No. 6,868,644, International patent application WO96/03262, and the European patent application 0 420 831, all herein incorporated by reference.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 2 is a sectional view taken generally along lines 2-2 of FIG. 1;

FIG. 2A is a sectional view of an alternate embodiment sidewall;

FIG. 2B is a sectional view taken generally along line 2B-2B of FIG. 2A;

DETAILED DESCRIPTION

Figure 1:
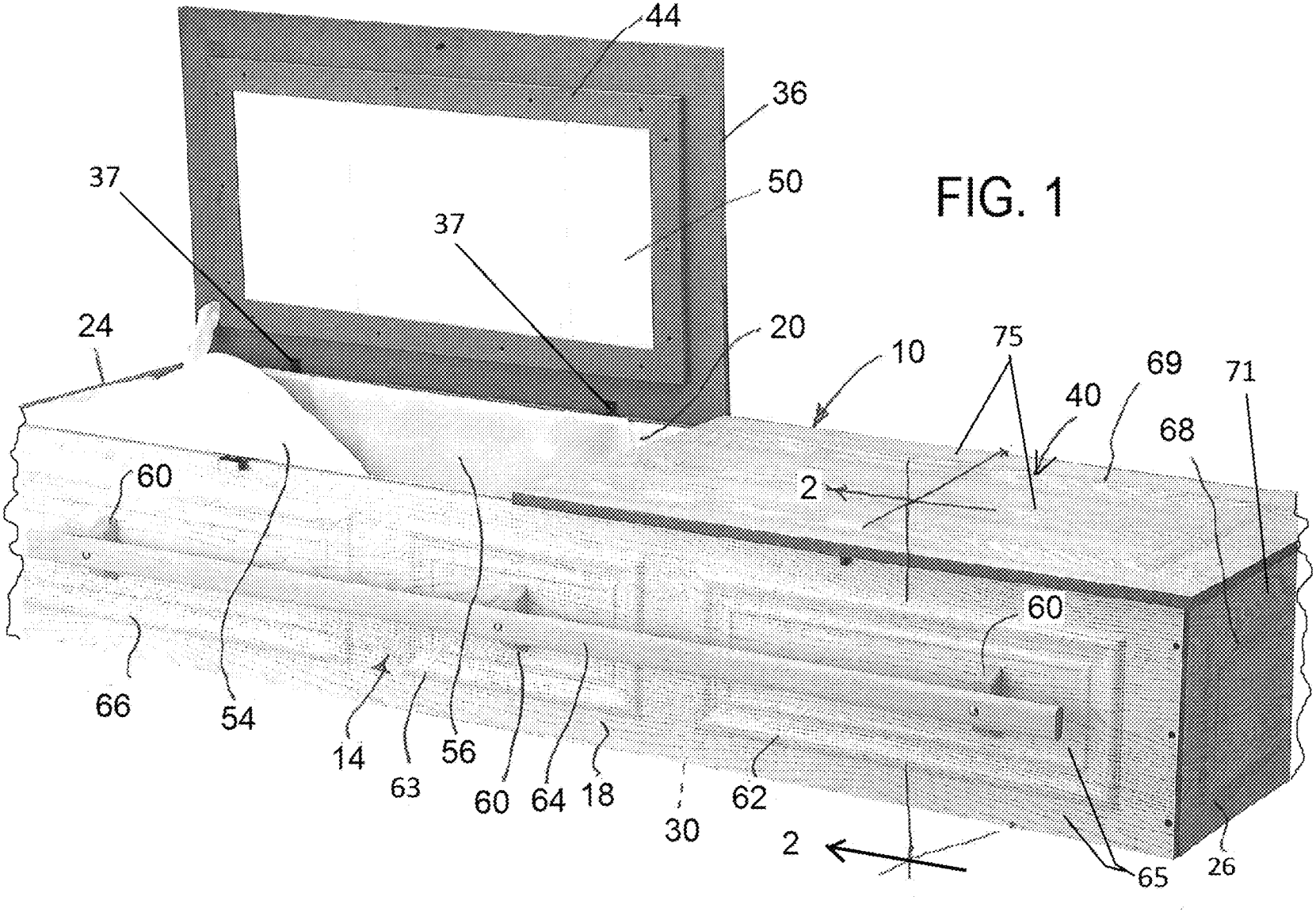
FIG. 1 is a perspective view of a casket manufactured according to an exemplary method of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference in its entirety U.S. Provisional Application Ser. No. 62/745,332, filed Oct. 13, 2018.

One prior art example of a purported economical casket construction is disclosed in U.S. Pat. No. 5,862,847, herein incorporated by reference. FIGS. 1-4 illustrate exemplary embodiments of the present invention.

FIG. 1 illustrates a casket 10 having a shell 14 including a first sidewall 18, a second sidewall 20, a first end wall 24, a second end wall 26, and a bottom wall 30 that closes the perimeter formed by the sidewalls and end walls. A head-end lid 36 is hinged by hinges 37 to the second sidewall 20. A foot-end lid 40 is hinged to the second sidewall 20 in similar fashion.

A bottom surface of the lid 36 optionally includes a decorative, add on rectangular trim 44 that surrounds a cap panel 50. This cap panel is for decorative purpose and includes a fabric with patterns or embroidery design wrapped on a piece of cardboard, or printings on a thin board. The rectangular trim 44, fastened to an underside of the lid 36, holds the cap panel 50 in place and is removable for changing the cap panel. Alternately, another embodiment of the casket can have a lid that is simply supported on the walls without hinges and is removed and replaced simply by lifting. A support pillow 54 and side fabric liners 56 are secured to the inside surfaces of the casket for aesthetic appearance.

A plurality of longitudinally spaced apart standoffs 60 are attached to and along the sidewall 18. A handle rail 64 is fastened to the standoffs 60 for lifting and transporting the casket 10 before and after a funeral ceremony. An identical arrangement of standoffs 60 and a further handle rail 64 are provided on the second sidewall 20 (shown in FIG. 2) in like fashion. Alternatively, no handle rail is provided on the sidewalls or the handles are smaller and do not extend the length of the casket, or handles are provided on the end walls instead of the sidewalls.

The sidewall 18 includes three rectangular trim moldings 62, 63, 66 that are raised from the dominant surface 65 of the sidewall 18 (convex). The trim moldings could alternatively be recessed below the dominant surface 65 of the sidewall 18 (concave), or both raised in part and recessed in part.

The second end wall 26 includes a rectangular trim molding 68 that is raised from a dominant surface 71 of the end wall 26. The trim molding 68 could alternatively be recessed below the dominant surface 71 of the end wall 26, or both raised in part and recessed in part.

The second sidewall 20 can have rectangular trim moldings 62, 63, 66 (FIG. 2) similar to those of the first sidewall 18. The first end wall 24 includes a rectangular trim molding 68 (not shown) similar to that of the second end wall 26. The trim molding 68 could alternatively be recessed below the dominant surface 71 of the first end wall 24, or both raised in part and recessed in part.

The lids 36 and 40 can each have a contoured trim molding 69, such as a raised and/or recessed rectangular portion, or both raised in part and recessed in part, from a dominant surface 75 of each lid.

FIG. 2 illustrates the construction of the sidewalls 18, 20, the end walls 24, 26 and the lids 36, 40. Each wall and lid includes an outside cladding supported by an inside structural wall. The sidewalls 18, 20 include outside sidewall cladding 18*a*, 20*a* which are adhesively secured to inside sidewall structural walls 18*b*, 20*b*. The end walls 24, 26 are also formed by an outside end wall cladding 24*a*, 26*a* adhesively secured to an inside end wall structural wall 24*b*, 26*b* in the same manner as the sidewall construction. The lids 36, 40 are formed by an outside lid cladding 36*a*, 40*a* adhesively secured to an inside lid structural wall 36*b*, 40*b*. The outside claddings 18*a*, 20*a*, 24*a*, 26*a*, 36*a*, 40*a* have a thickness of about 3 mm to 5 mm and are advantageously composed of MDF. The inside structural walls 18*b*, 20*b*, 24*b*, 26*b*, 36*b*, 40*b* have a thickness of about 15 mm and can be composed of MDF. The outside sidewall claddings 18*a*, 20*a* have a substantially consistent thickness and the trim moldings 62, 63, 66 are formed by distorting the claddings 18*a*, 20*a* by pressing or molding the claddings 18*a*, 20*a*. The outside end wall cladding 24*a*, 26*a* have similar trim moldings 68.

Figure 3:
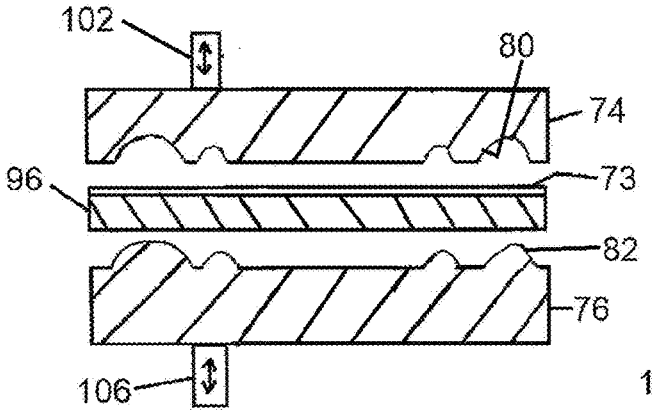
FIG. 3 is a schematic view of a mold used in forming a contoured wall cladding before the mold is closed.
Figure 4:
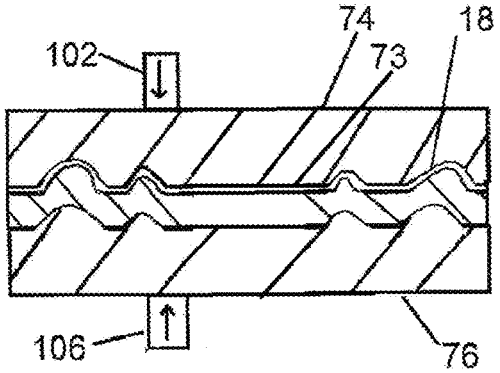
FIG. 4 is a schematic view of the mold of FIG. 3 after the mold is closed.

A lamination or other decorative covering 73 can be applied over the side wall claddings, end wall claddings and lid claddings. This lamination can be applied to a flat board 96 before the board is molding into a cladding as shown in FIGS. 3 and 4. The molding shown in FIG. 4 can adhere the laminate tightly to the board being molded. Alternately, the lamination can be applied after the molding. The lamination can be a wood or paper laminate veneer. The lamination can display a wood grain. Alternatively, the laminate can be a solid color or design patterns to look like metal, camouflage or other surface appearance.

FIG. 3 schematically illustrates a mold that can be used to form any of the sidewall, end wall or lid contoured surfaces. A first mold half 74 has a concave formation 80 and a second mold half 76 has a convex formation 82 that is the same shape and respective location as the formation 80. The flat board 96, such as an MDF board is heated and treated with steam in such a way that the material reaches it thermal softening point and then placed between the mold halves 74, 76, when the mold is open. The mold halves 74, 76 can have a length into the page of FIG. 3 equal to or greater than the board 96.

As shown in FIG. 4, the upper mold half 74 and the lower mold half 76 respectively delimit in the closed state of the mold, a specifically shaped mold cavity. When the mold halves 74, 76 are forcefully brought together by one or more hydraulic cylinders 102, 106, as shown in FIG. 4, the board is distorted according to the complementary formations 80, 82 to form, for example, the raised and or recessed trim moldings 62, 63, 66 in the sidewall cladding 18*a*. The other sidewall cladding 20*a*, the end wall claddings 24*a*, 26*a* and the lid claddings 36*a*, 40*a* can all be molded in similar manner to provide the trim moldings 62, 63, 66, 68 and 69.

One method for molding the trim moldings on the flat board 96 is described in more detail in U.S. Pat. No. 6,868,644 herein incorporated by reference.

By a pre-selected relative movement of the upper mold half 74 and the lower mold half 76, the wood fiber board will be plastically deformed to form a contoured profile in the board 96.

Before the board 96 is positioned between the upper mold half 74 and the lower mold half 76, a decorative layer or lamination 73 can be arranged on a top surface of the board 96 which may then be joined with or adhered to the top surface of the board 96 during the pressing or molding operation, as shown in FIG. 4. The formed wall cladding will in that case obtain a synthetic surface which is desirable for certain applications.

Although rectangular trim moldings are described for the side walls, end walls and lids, many other shapes are encompassed by the invention, including oval or round shapes, curved line shapes, straight line shapes, an oval shape in the middle and straight line plus curved line trims on the left and right sides.

Figure 5:
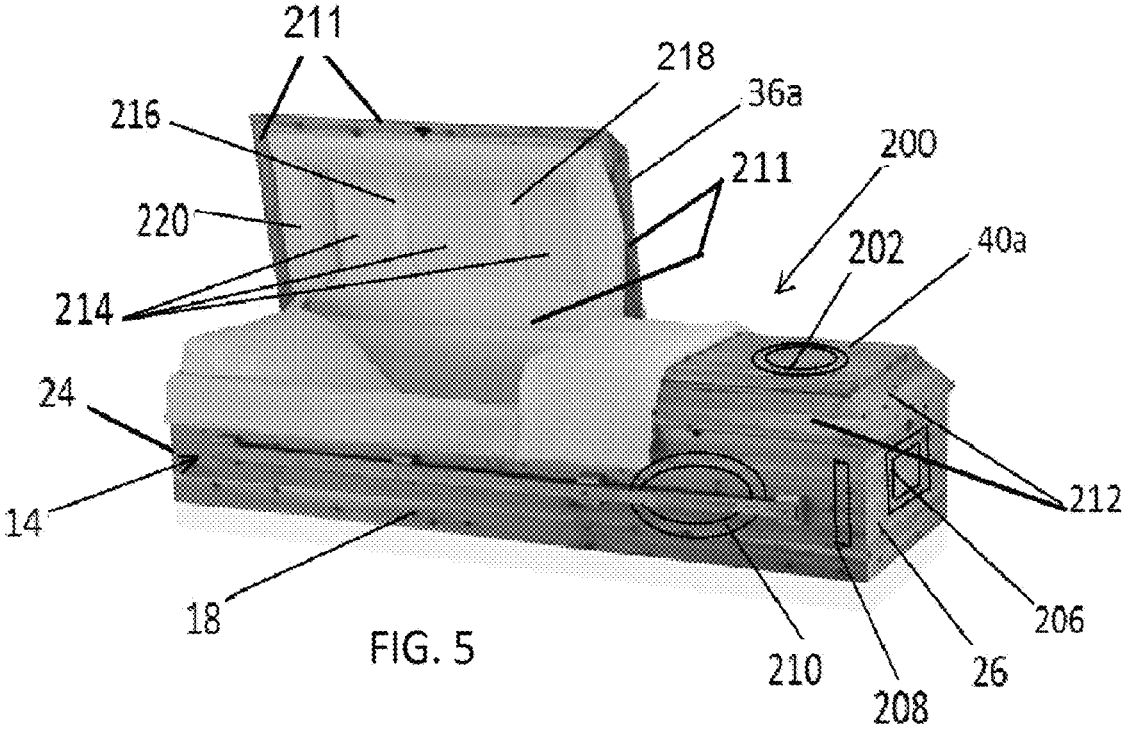
FIG. 5 is a perspective view of an alternate embodiment casket.

FIG. 5 illustrates an alternate embodiment casket 200. The casket 200 has many common features with the casket 10 shown in FIG. 1 except as noted. Lids 236, 240 can have one or more oval trim moldings 202 being either raised or recessed from the outside dominant surface of the lids. The end wall 26 includes one or more rectangular trim moldings 208 that are either raised or recessed from the outside dominant surface of the end wall 26. The sidewall 18 includes one or more trim moldings 208 that comprise a straight or curved line, either raised or recessed from the outside dominant surface of the sidewall 18. The sidewall 18 includes one or more oval trim moldings 210 being either raised or recessed from the outside dominant surface of the sidewall 18. The trim moldings 202, 206, 208, 210 are molded or pressed into the lid claddings, sidewall claddings and end wall claddings in the same fashion as previously described. All of the lids, end walls and sidewalls can have raised and/or recessed molding trims.

Although particular shaped trim moldings are described for the side walls, end walls and lids, many other shapes are encompassed by the invention, including oval or round shapes, curved line shapes, straight line shapes, an oval shape in the middle and straight line plus curved line trims on the left and right sides.

The head-end lid 36 of FIG. 1 is replaced with a head-end cap 236 in FIG. 5 that is concave instead of flat, having a surrounding skirt 211 covered by fabric-covered decorative trim 220. A three-panel cap panel 214 is held in place by the decorative trim 220 and two frame members 216, 218. The panel can be one piece under the members 216, 218 or multiple pieces. The foot-end lid 40 of FIG. 1 is replaced with a foot-end cap 240 in FIG. 5 that is concave instead of flat, having a surrounding skirt 212. The caps 236, 240 can be hinged to the sidewall 20 or can be simply supported to be placed on or off the sidewalls and end walls.

The lid cladding of the head-end cap 236 and the foot-end cap 240 can be formed into the concave shape by pressing and molding a flat fiberboard into the concave shape, forming the surrounding skirts 211, 212, at the same time that trim moldings 202 are pressed and molded into a lid cladding of the caps 236, 240.

The sidewall claddings 18*a*, 20*a*, the end wall claddings 24*a*, 26*a* and the lid claddings 36*a*, 236*a*, 40*a*, 240*a* can be formed of MDF having a thickness of 3 mm to 5 mm. The inside structural walls 18*b*, 20*b*, 24*b*, 26*b*, 36*b*, 40*b*, 236*b*, 240*b* can have a thickness of about 15 mm. The overall thickness of the sidewalls and end walls can be within a range of 15 mm to 22 mm.

FIGS. 2A and 2B illustrates an alternate method of constructing each of the sidewalls, end walls and lids. For illustrating the alternate construction only one sidewall 300 is shown and described with the understanding that the same construction could be applied to both sidewalls, the end walls and the lids, both flat and cap lids. An outside cladding 302 is formed as previously described. A ladder frame 308, having horizontal members 303 and vertical members 304, which can be composed of MDF or wood, is adhesively or otherwise secured to a back side of the cladding. The frame 308 has open areas 310, 311 to accommodate any trim molding 320, 322 that is recessed below the outside dominant surface 328 of the sidewall. A flat back board 330, which can be composed of MDF, is adhesively or otherwise secured to a back side of the frame 308 to form a smooth surface inside of the casket. The frame can have a thickness of 10-15 mm and the cladding and the board can each have a thickness of about 3-5 mm.

The sidewall claddings, the end wall claddings and the lid claddings are shown as covering the inside structural wall completely and coextensively. However the invention also encompasses a cladding that covers only a portion of the structural wall.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A method of manufacturing caskets, comprising the steps of:

providing a casket shell including opposite inner side walls and opposite inner end walls, a bottom wall and a lid;

providing outer side walls and outer end walls and forming at least one of the outer side walls and outer end walls with a contoured surface in a central region surrounded by a flat surface, the contoured surface having convex and concave portions by molding a medium density fiberboard between co-acting mold walls to plastically deform the fiberboard into the contoured surface; and assembling the outer side walls to the inner side walls respectively via interposed side wall frames; and assembling the outer end walls to the inner end walls respectively via interposed end wall frames; and assembling the inner side walls, the inner end walls, the outer side walls, the outer end walls, the side wall frames, the end wall frames, the bottom wall and the lid into an openable box.

2. The method according to claim 1, wherein the step of forming at least one of the outer side walls and outer end walls with a contoured surface in a central region surrounded by a flat surface, the contoured surface having convex and concave portions by molding a medium density fiberboard between co-acting mold walls to plastically deform the fiberboard into the contoured surface is further defined in that all four of the outer side walls and outer end walls have contoured surfaces in respective central regions surrounded by respective flat surfaces, the contoured surfaces having convex and concave portions by molding medium density fiberboard between co-acting mold walls to plastically deform the fiberboard into the contoured surfaces.

3. The method according to claim 2, wherein the convex and concave portions form rectangular trims.

4. The method according to claim 2, comprising the step of forming the lid with a contoured surface by molding a medium density fiberboard between co-acting mold walls.

5. The method according to claim 1, wherein the convex and concave portions form a rectangular trim.

6. The method according to claim 1, comprising the step of forming the lid with a contoured surface by molding a medium density fiberboard between co-acting mold walls.

7. A casket, comprising:

a casket shell including opposite side walls and opposite end walls, a bottom wall and a lid;

the opposite side walls, the opposite end walls, the bottom wall and the lid assembled into an openable box;

wherein each of the opposite side walls and the opposite end walls comprises an outer cladding portion formed of medium density fiberboard and having a molded contoured surface in a central region surrounded by a flat surface, the contoured surface having raised and recessed portions, and two inner side walls and two inner end walls, each of the two inner side walls and two inner end walls secured to a back side of a respective outer cladding portion, wherein each of the inner side walls and the inner end walls is secured to the respective outer cladding portion via a respective frame.

8. The casket according to claim 7, wherein all four of the side walls and end walls have cladding portions having contoured surfaces in respective central regions surrounded by flat surfaces, the contoured surfaces having raised and recessed portions.

9. The casket according to claim 8, wherein the lid is formed of medium density fiberboard having a molded contoured surface formed by molding the medium density fiberboard between co-acting mold walls.

10. The casket according to claim 7, wherein the raised or recessed portions are raised or recessed from the dominant surface of the at least one of the side walls and end walls.

11. The casket according to claim 10, wherein the raised or recessed portions form a rectangular trim.

12. The casket according to claim 11, wherein all four of the side walls and end walls have contoured surfaces in respective central regions surrounded by flat surfaces, the contoured surfaces having raised and recessed portions forming rectangular trims.

13. The casket according to claim 7, wherein the lid comprises a contoured surface formed by molding a medium density fiberboard between co-acting mold walls.

* * * * *